US011111623B2

(12) United States Patent
Nam et al.

(10) Patent No.: US 11,111,623 B2
(45) Date of Patent: Sep. 7, 2021

(54) DRYING DEVICE AND CLOTHES TREATING APPARATUS INCLUDING THE SAME

(71) Applicant: Samsung Electronics Co., Ltd., Suwon-si (KR)

(72) Inventors: Yeon-Young Nam, Goyang-si (KR); Tim Rochford, Seongnam-si (KR); Ji Hyeoung Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/473,229

(22) PCT Filed: Nov. 13, 2017

(86) PCT No.: PCT/KR2017/012775
§ 371 (c)(1),
(2) Date: Jun. 24, 2019

(87) PCT Pub. No.: WO2018/117422
PCT Pub. Date: Jun. 28, 2018

(65) Prior Publication Data

US 2019/0330791 A1 Oct. 31, 2019

(30) Foreign Application Priority Data

Dec. 23, 2016 (KR) ..... 10-2016-0178594

(51) Int. Cl.
*F26B 25/06* (2006.01)
*D06F 58/10* (2006.01)
(Continued)

(52) U.S. Cl.
CPC ..... *D06F 58/10* (2013.01); *D06F 58/04* (2013.01); *D06F 58/16* (2013.01); *D06F 58/20* (2013.01); *D06F 58/26* (2013.01)

(58) Field of Classification Search
CPC ..... D06F 58/10; D06F 58/04; D06F 58/16; D06F 58/26; D06F 58/20
(Continued)

(56) References Cited

U.S. PATENT DOCUMENTS 2,645,863 A * 7/1953 Morrison ..... D06F 58/10 34/239
4,180,919 A 1/1980 Baltes
(Continued)

FOREIGN PATENT DOCUMENTS

CN 101175884 A 5/2008
CN 105780422 A 7/2016
(Continued)

OTHER PUBLICATIONS

Communication pursuant to Article 94(3) EPC in connection with European Application No. 17882795.2 dated Jun. 16, 2020, 4 pages.
(Continued)

*Primary Examiner* — John P McCormack

(57) ABSTRACT

Provided are a drying device having an improved structure in which an object to be dried is prevented from being damaged during a drying operation, and a clothes treating apparatus including the same. The drying device may include a casing, a drying chamber positioned inside the casing, a first drying rack positioned inside the drying chamber, and a second drying rack positioned above the first drying rack.

8 Claims, 18 Drawing Sheets

(51) Int. Cl.

| | |
|---|---|
| ***D06F 58/16*** | (2006.01) |
| ***D06F 58/20*** | (2006.01) |
| ***D06F 58/04*** | (2006.01) |
| ***D06F 58/26*** | (2006.01) |

(58) Field of Classification Search
USPC ..... 34/201, 192, 194, 202, 209, 210, 218, 34/235, 237, 238
See application file for complete search history.

(56) References Cited

U.S. PATENT DOCUMENTS

| | | | | |
|---|---|---|---|---|
| 8,716,628 | B2 * | 5/2014 | Bari | D06F 39/12 219/211 |
| 2006/0137208 | A1 * | 6/2006 | Lee | D06F 73/02 34/130 |
| 2007/0151120 | A1 * | 7/2007 | Tomasi | D06F 58/10 34/601 |
| 2014/0360043 | A1 | 12/2014 | Baek | |
| 2017/0226678 | A1 * | 8/2017 | Underly | A47B 46/005 |

FOREIGN PATENT DOCUMENTS

| | | | |
|---|---|---|---|
| EP | 1146161 | A1 | 10/2001 |
| EP | 2194184 | A1 | 6/2010 |
| EP | 2199453 | A1 | 6/2010 |
| KR | 10-0530602 | B1 | 11/2005 |
| KR | 10-2006-0060213 | A | 6/2006 |
| KR | 10-2014-0058763 | A | 5/2014 |

OTHER PUBLICATIONS

Supplementary European Search Report dated Oct. 7, 2019 in connection with European Patent Application No. 17 88 2795, 6 pages.
ISA/KR, "International Search Report and Written Opinion of the International Searching Authority," International Application No. PCT/KR2017/012775, dated Feb. 21, 2018, 10 pages.
Office Action dated Jan. 4, 2021 in connection with Chinese Patent Application No. 201780086927.3, 21 pages.
Communication pursuant to Article 94(3) EPC dated Nov. 27, 2020 in connection with European Patent Application No. 17 882 795.2, 5 pages.
The Second Office Action dated Jun. 17, 2021 in connection with Chinese Patent Application No. 201780086927.3, 14 pages.

* cited by examiner

DRYING DEVICE AND CLOTHES TREATING APPARATUS INCLUDING THE SAME

CROSS-REFERENCE TO RELATED APPLICATIONS

This application is a 371 National Stage of International Application No. PCT/KR2017/012775, filed Nov. 13, 2017, which claims priority to Korean Patent Application No. 10-2016-0178594, filed Dec. 23, 2016, the disclosures of which are herein incorporated by reference in their entirety.

BACKGROUND

1. Field

The present invention relates to a drying device and a clothes treating apparatus including the same, and more particularly, to a drying device having an improved structure in which an object to be dried is prevented from being damaged during a drying operation, and a clothes treating apparatus including the same.

2. Description of Related Art

In general, drying devices are devices in which hot air passes through an inside of a drum accommodating an object to be dried while the drum is rotated at a low speed, so that the object to be dried inside the drum can be dried.

Drying devices each may include a drum in which the object to be dried is accommodated and which is rotatably installed, a driving unit for driving the drum, a blower unit for blowing air into an inside of the rotating drum, a supply flow path that guides the introduction of air into the drum, and a discharge flow path that guides air discharged from the drum.

When the drying device operates after the object to be dried is put into the drum, due to the operation of the driving unit, the drum is rotated and simultaneously, due to the operation of the blower unit, air is blown into the drum. Thus, the object to be dried accommodated in the drum is repeatedly lifted or dropped due to rotation of the drum and thus can be dried at a high speed.

However, in such a rotating-type drying device, lifting/dropping of the object to be dried is repeatedly performed due to a rotating operation of the drum so that the object to be dried may be damaged by a mechanical force exerted on the object to be dried.

SUMMARY

The present invention is directed to providing a drying device having an improved structure in which drying efficiency can be improved, and a clothes treating apparatus including the same.

The present invention is also directed to providing a drying device having an improved structure in which damage to an object to be dried can be minimized, and a clothes treating apparatus including the same.

The present invention is also directed to providing a drying device having an improved structure in which space utilization of a drying chamber is improved, and a clothes treating apparatus including the same.

One aspect of the present invention provides a drying device including: a casing; a drying chamber positioned inside the casing; a first drying rack positioned inside the drying chamber; and a second drying rack positioned above the first drying rack.

The second drying rack may include a frame having a handle therein, and a mesh body coupled to the frame.

The drying device may further include a guide rail positioned at both inner walls of the drying chamber and configured to support the second drying rack.

The drying device may further include a winder rotatably installed so that the mesh body is wound on the winder.

The drying device may further include a drying duct configured so that air supplied into the drying chamber flows, and an upper plate of the drying duct forms a bottom plate of the drying chamber.

A plurality of blowing ports may be provided in the bottom plate of the drying chamber.

The drying device may further include a heater configured to heat air supplied into the drying chamber.

The drying device may further include an intake unit positioned adjacent to the heater so that air heated by the heater is blown into the drying chamber.

The intake unit may be coupled to the drying duct.

The drying device may further include a door installed on the casing so as to open or close the drying chamber.

The first drying rack may include a drying flow path, which is formed in the first drying rack and in which air flows, and a plurality of air flow holes provided in the first drying rack so that the drying flow path communicates with the drying chamber.

The plurality of air flow holes may be formed in a top surface and a bottom surface of the first drying rack.

Another aspect of the present invention provides a drying device including: a casing; a drying chamber positioned inside the casing; and a drying rack rotatably installed inside the drying chamber, and the drying rack may include a drying rack flow path formed in the drying rack so that air flows in the drying rack flow path, and a plurality of air flow holes formed in the drying rack so that the drying rack flow path communicates with the drying chamber.

A plurality of blowing ports may be provided in a bottom plate of the drying chamber so that air is supplied into the drying chamber through the plurality of blowing ports.

The plurality of air flow holes may be formed in a top surface and a bottom surface of the drying rack.

An internal space of the drying chamber may be divided into an upper space and a lower space in a state in which the drying rack is interposed between the upper space and the lower space, when the drying rack is parallel to the bottom plate of the drying chamber.

The drying device according to the spirit of the present invention may further include an air inlet through which air is introduced in the drying rack flow path, and the air inlet may be positioned close to a rotating shaft of the drying rack.

The drying device according to the spirit of the present invention may further include a door rotatably installed on the casing so as to open or close the drying chamber, and a rotating shaft of the door and the rotating shaft of the drying rack may be parallel to each other.

Another aspect of the present invention provides a clothes treating apparatus including: a main body having a clothes treating space therein, and a drying device positioned at an upper portion of the main body, and the drying device may include a casing, a drying chamber positioned inside the casing, a door configured to open or close the drying chamber, a first drying rack installed inside the drying chamber, and a second drying rack positioned between the door and the first drying rack.

The second drying rack may include a mesh body through which air inside the drying chamber flows.

An object to be dried is dried using hot air instead of using a rotating-type drying device so that the object to be dried can be prevented from being damaged by a mechanical force exerted on the object to be dried while the rotating-type drying device is used.

A second drying rack is installed to be put into or taken out of a drying chamber or to be rotatable so that space utilization of the drying chamber can be improved.

A drying rack on which the object to be dried is hung and dried, is installed in the drying chamber so that the object to be dried can be efficiently dried.

DETAILED DESCRIPTION

Figure 1:
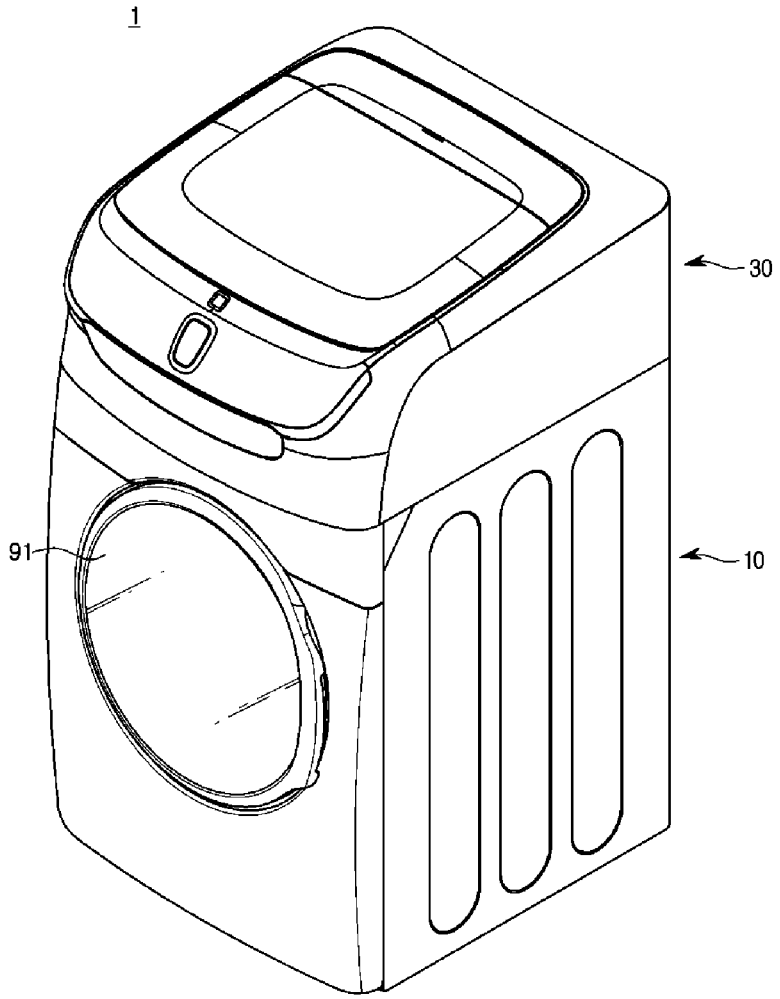
FIG. 1 is a perspective view of a clothes treating apparatus according to an embodiment of the present invention.

Hereinafter, exemplary embodiments of the present invention will be described in detail. Meanwhile, the terms used herein, such as a "front end", a "rear end", an "upper portion", a "lower portion", a "top end", and a "bottom end", are defined based on the drawings, and the shape and position of each element are not limited by the terms.

A clothes treating apparatus is a concept including all apparatuses for treating clothes. In detail, the clothes treating apparatus may include various types of apparatuses that are capable of washing or drying clothes, or removing wrinkles from clothing. In an example, the clothes treating apparatus may include an apparatus for washing clothes, an apparatus for drying clothes, or an apparatus for performing both washing and drying of clothes. Types of the clothes treating apparatus are not limited to the above example.

Hereinafter, clothes include the concept of clothing. Thus, clothes may be used as a concept including all wearable items, such as hats, gloves, shoes, and the like, as well as clothes. Hereinafter, a reference character "L" represents an object to be dried.

Hereinafter, when only one of a first drying rack and a second drying rack is installed, the one may be referred to as a "drying rack".

FIG. 1 is a perspective view of a clothes treating apparatus according to an embodiment of the present invention.

As illustrated in FIG. 1, a clothes treating apparatus 1 may include a main body 10 that constitutes an exterior of the clothes treating apparatus 1.

The clothes treating apparatus 1 may further include a clothes treating space formed in the main body 10. The clothes treating space may be formed in the main body 10 so as to accommodate clothes.

The clothes treating apparatus 1 may further include a door 91 installed on the main body 10 to be rotatable so as to open or close the clothes treating space.

The clothes treating apparatus 1 may further include a drying device 30.

The drying device 30 may be positioned at an upper portion of the main body 10. A detailed description of the drying device 30 will be provided below.

Figure 2:
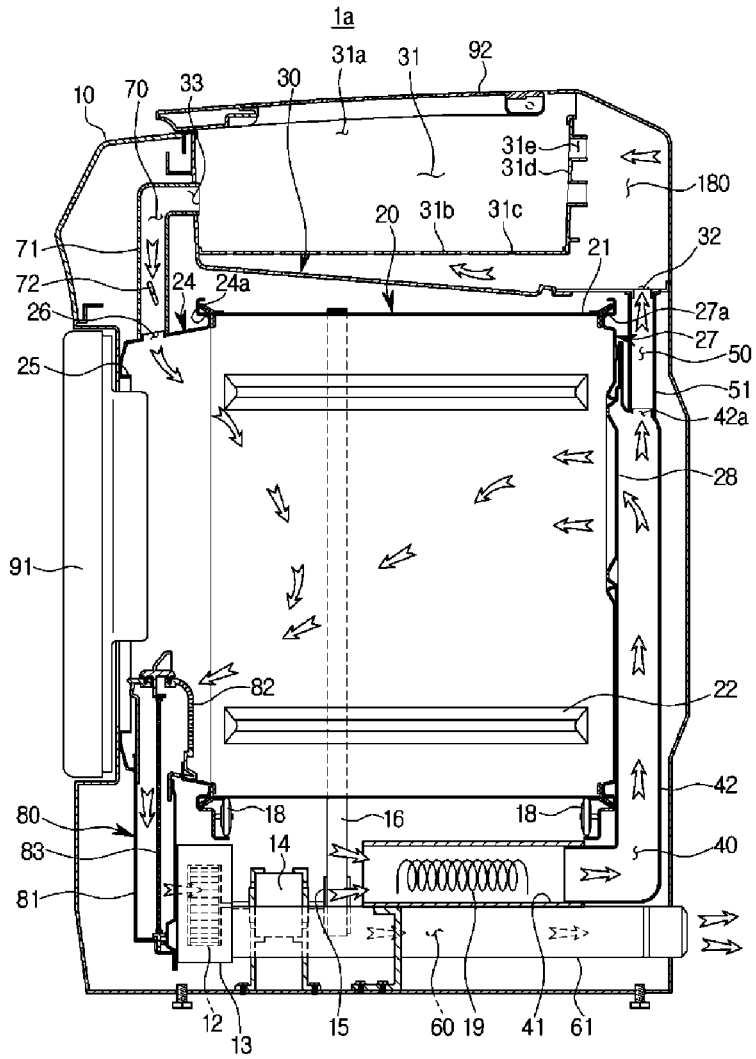
FIG. 2 is a first exemplary view of the clothes treating apparatus according to an embodiment of the present invention.

FIG. 2 is a first exemplary view of a clothes treating apparatus according to an embodiment of the present invention.

As illustrated in FIG. 2, a clothes treating apparatus 1*a* may include a plurality of drying devices. In other words, the clothes treating apparatus 1*a* may include a plurality of drying devices that perform a drying cycle for an object to be dried in different ways. In an example, the clothes treating apparatus 1*a* may include a rotating-type drying device and a non-rotating-type drying device. Hereinafter, the clothes treating apparatus 1*a* including the rotating-type drying device and the non-rotating-type drying device will be described.

The clothes treating apparatus 1*a* may include the main body 10. The main body 10 may have an approximately box shape. A first door 91 that opens/closes a first input port 25 of a first drying unit 20 may be positioned at a front surface of the main body 10. The first door 91 may be rotatably installed on the main body 10. A second door 92 that opens/closes a second input port 31*a* of a second drying unit 30 may be positioned at a top surface of the main body 10. The second door 92 may be rotatably installed on the main body 10 so as to open or close the second input port 31*a*. A control panel (not shown) through which various types of information about the clothes treating apparatus 1*a* may be displayed or operating instructions may be input, may be positioned at an upper portion of the front surface of the main body 10.

The clothes treating apparatus 1*a* may further include the first drying unit 20 that dries the object to be dried in a rotating manner. The first drying unit 20 may include a rotating drum 21 having a cylindrical shape with opened front and rear surfaces and positioned to be rotatable. The first drying unit 20 may further include a front support plate 24 and a rear support plate 27 configured to support the rotating drum 21.

The front support plate 24 may include a front support part 24*a* that supports a front end part of the rotating drum 21, the first input port 25 through which the object to be dried may be put into the first drying unit 20, and a connection port 26 through which air of the second drying unit 30 is introduced.

The rear support plate 27 may include a rear support part 27*a* configured to support a rear end of the rotating drum 21, and an intake port 28 through which external air is introduced into the first drying unit 20.

A roller 18 that supports the rotating drum 21 for smooth rotation thereof, may be positioned under the rotating drum 21. A lifter 22 that lifts the object to be dried, may be positioned on an inner circumferential surface of the rotating drum 21.

The clothes treating apparatus 1*a* may further include a driving motor 14 that generates a driving force for rotating the rotating drum 21 and simultaneously operating a blower fan 12. The blower fan 12 may be connected to one end of a rotating shaft of the driving motor 14, and a pulley 15 may be connected to the other end of the rotating shaft. An outside surface of the pulley 15 may be connected to an outside surface of the rotating drum 21 via a belt 16 so that the driving force of the driving motor 14 can be transferred to the rotating drum 21.

The clothes treating apparatus 1*a* may further include the second drying unit 30. The second drying unit 30 may be positioned above the first drying unit 20. The second drying unit 30 may dry the object to be dried in a non-rotating manner. That is, the second drying unit 30 may not be rotated but may be maintained in a fixed state.

The second drying unit 30 may include a drying chamber 31 in which the object to be dried is accommodated. The drying chamber 31 may have one opened surface. The one opened surface of the drying chamber 31 may be defined as a second input port 31*a*. As described above, the second input port 31*a* may be opened/closed by the second door 92. A plurality of blowing ports 31*c* may be formed in a bottom plate 31*b* of the drying chamber 31.

The second drying unit 30 may further include a drying duct 180 formed between the main body 10 and the drying chamber 31. A first supply flow path 40 may be connected to the drying duct 180 via a second supply flow path 50. An inlet 32 through which air passing through the second supply flow path 50 may be introduced into the drying duct 180, may be formed at a connection part between the second supply flow path 50 and the drying duct 180. The air introduced into the drying duct 180 through the inlet 32 may flow into the drying chamber 31. In detail, the air introduced into the drying duct 180 may flow into the drying chamber 31 through the plurality of blowing ports 31*c* formed in the bottom plate 31*b* of the drying chamber 31 and at least one air inlet 31*e* formed at a rear surface 31*d* of the drying chamber 31. The air introduced into the drying chamber 31 may be used to dry the object to be dried inside the drying chamber 31. The air introduced into the drying chamber 31 may be discharged to an outside of the drying chamber 31.

The size of the drying chamber 31 of the second drying unit 30 may be smaller than the size of the rotating drum 21 of the first drying unit 20. Thus, the quantity of the object to be dried accommodated in the drying chamber 31 may be smaller than the quantity of the object to be dried accommodated in the rotating drum 21.

The second drying unit 30 may further include a second input port 31*a* through which the object to be dried may be put into the drying chamber 31. The second input port 31*a* may be formed at a top surface of the drying chamber 31.

The second drying unit 30 may further include the inlet 32 into which external air is introduced, and an outlet 33 from which the air inside the drying chamber 31 is discharged to the outside.

The clothes treating apparatus 1*a* may further include the first supply flow path 40 configured to supply air to the first drying unit 20, the second supply flow path 50 diverged from the first supply flow path 40 so as to supply air to the second drying unit 30, a first discharge flow path 60 configured to discharge the air of the first drying unit 20, and a second discharge flow path 70 configured to discharge the air of the second drying unit 30 via the first drying unit 20.

The first supply flow path 40 may be formed by supply ducts 41 and 42. The supply ducts 41 and 42 may include a lower supply duct 41 formed at an approximately a lower portion of the first drying unit 20, and a rear supply duct 42 having one end coupled to the lower supply duct 41 and the other end coupled to the intake port 28 of the first drying unit 20. A heater 19 may be installed inside at least one of the main body 10 of the first drying unit 20 and the main body 10 of the second drying unit 30 so as to heat air introduced into at least one of the rotating drum 21 and the drying chamber 31 which exemplify a clothes treating space. In the current embodiment, the heater 19 may be positioned on the first supply flow path 40 so as to heat air that flows in the first supply flow path 40.

The second supply flow path 50 may be formed by an inlet duct 51. The inlet duct 51 may connect a branch port 42*a* of the rear supply duct 42 to the inlet 32 of the second drying unit 30. FIG. 2 illustrates the case where the inlet duct 51 and the rear supply duct 42 are separately provided. However, the inlet duct 51 and the rear supply duct 42 may also be integrally formed.

The first discharge flow path 60 may be formed by a filter case 81, a blower fan case 13, and a discharge duct 61.

The second discharge flow path 70 may be formed by an outlet duct 71. The outlet duct 71 may connect an outlet 33 of the second drying unit 30 to the connection port 26 of the front support plate 24.

Through this configuration, when the driving motor 14 operates, the driving force generated by the driving motor 14 is transferred to the rotating drum 21 via the pulley 15 and the belt 16. Thus, the rotating drum 21 rotates.

Also, the driving force generated by the driving motor 14 may be used to rotate the blower fan 12 so that a flow of air is generated. Thus, external air is supplied to the first drying unit 20 and the second drying unit 30 via the first supply flow path 40 and the second supply flow path 50, respectively. The air humidified after being used to dry the object to be dried in the first drying unit 20, is discharged via the first discharge flow path 60. The air humidified after being used to dry the object to be dried in the second drying unit 30, is guided into the first drying unit 20 via the second discharge flow path 70 and then is finally discharged via the first discharge flow path 60.

A filter 80 that filters foreign matter from the air discharged via the first discharge flow path 60 may be mounted on a lower portion of the front support plate 24. The filter 80 may include the filter case 81, a grill 82 formed on one surface of the filter case 81, and a filter member 83 positioned inside the filter case 81.

Unlike the above, when the driving motor 14 operates, air may not be supplied to the second drying unit 30 but may be supplied only to the first drying unit 20. To this end, a shutter 72 may be positioned in the second discharge flow path 70 that guides the air of the second drying unit 30 toward the first drying unit 20.

That is, when drying is performed using both the first drying unit 20 and the second drying unit 30, the shutter 72 may be opened so that air may be supplied to both the first drying unit 20 and the second drying unit 30. Unlike this, when the second drying unit 30 is not used but only the first drying unit 20 is used, the shutter 72 may be closed so that air may not flow into the second drying unit 30.

FIG. 2 illustrates the case where the shutter 72 is positioned in the second discharge flow path 70. However, the position of the shutter 72 is not limited to the above example. In an example, the shutter 72 may also be positioned in the second supply flow path 50.

In this way, the clothes treating apparatus 1*a* includes the rotating-type, first drying unit 20 and the non-rotating-type, second drying unit 30, which are positioned inside the main body 10, so that a user can select and use rotating-type drying or non-rotating-type drying according to characteristics of the object to be dried.

Also, because drying air (hot air) can be supplied to both the first drying unit 20 and the second drying unit 30 using one heater 19 and one blower fan 12, an internal structure of the clothes treating apparatus 1*a* is simple, and an effective drying space thereof can be enlarged. However, the second drying unit 30 may also include a heater and a blower fan only for the second drying unit 30 separately from the first drying unit 20.

Also, because the air of the second drying unit 30 is not directly discharged but is discharged via the first drying unit 20, a flow path structure thereof is simple. Also, the air passing through the second drying unit 30 having a relatively small load may not directly discharged but may be reused so that the effect of improving drying efficiency can be expected.

Figure 3:
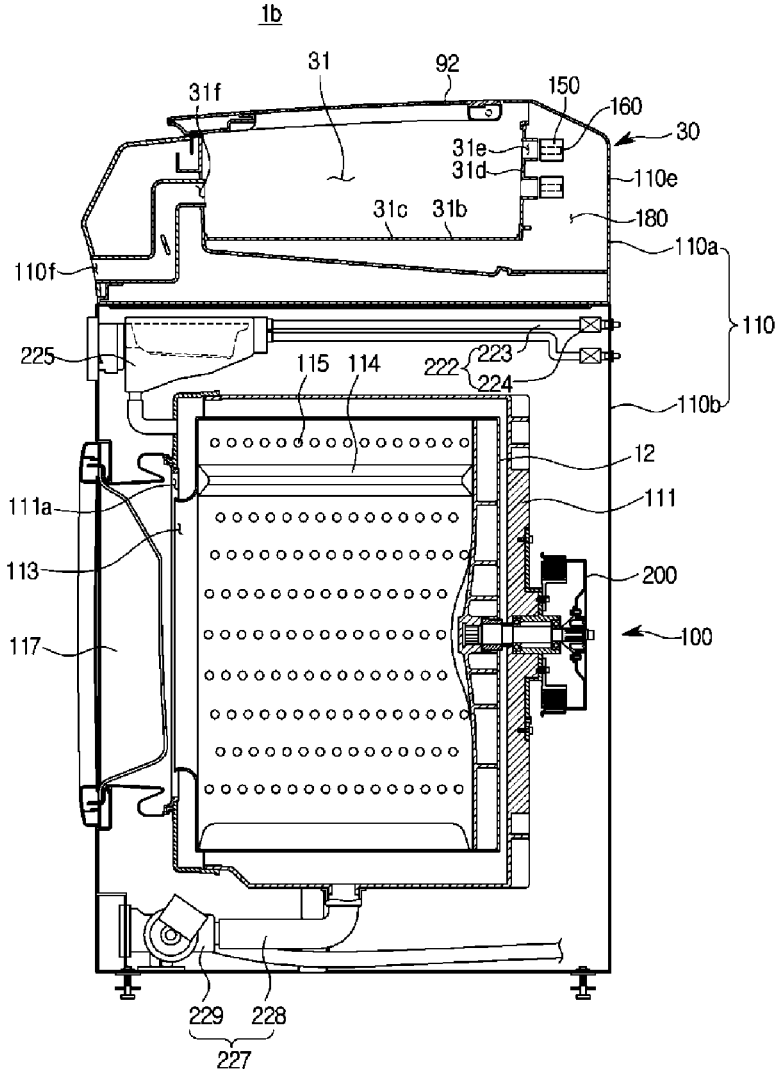
FIG. 3 is a second exemplary view of the clothes treating apparatus according to an embodiment of the present invention.

FIG. 3 is a second exemplary view of a clothes treating apparatus according to an embodiment of the present invention.

As illustrated in FIG. 3, a clothes treating apparatus 1*b* may include a washing device and a drying device. The washing device may include a drum-type washing machine. The drum-type washing machine lifts and drops laundry using a lifter positioned at an inner circumferential surface of a drum so that the laundry can be washed. Such a drum-type washing machine uses a front loading method by which the laundry is introduced from a front direction. However, types of the washing machine are not limited to the drum-type washing machine. Hereinafter, the clothes treating apparatus 1*b* including the drum-type washing machine used as a washing apparatus will be described.

As illustrated in FIG. 3, the clothes treating apparatus 1*b* may include a main body 110 that constitutes an exterior of the clothes treating apparatus 1*b*. The main body 110 may include an upper main body 110*a* that constitutes an exterior of a drying device 30, and a lower main body 110*b* that constitutes an exterior of the washing device 100. The upper main body 110 and the lower main body 110*b* may be integrally formed or may also be separately provided and thus assembled.

The clothes treating apparatus 1*b* may further include the washing device 100. The washing device 100 may have a similar structure to that of a drum washing machine that uses a general front loading method.

In detail, the washing device 100 may include a tub 111 in which washing water is stored.

The washing device 100 may further include a drum 112 rotatably installed in the tub 111 so as to accommodate the laundry. The drum 112 may have a cylindrical shape. The drum 112 may rotate due to a rotating force supplied from a motor 200. A lifter 114 may be positioned at an inner circumferential surface of the drum 112 so as to lift or drop the laundry to agitate the laundry and to impact the laundry. A through hole 115 may be formed in the drum 112 so that the washing water stored in the tub 111 flows. The drum 112 may have a sufficient size in which large laundry such as a coat or blanket or a large quantity of laundry can be treated.

Openings 111*a* and 113 may be formed in the front of each of the tub 111 and the drum 112. The laundry may be put into the drum 112 via the openings 111*a* and 113.

The washing device 100 may further include a door 117 rotatably installed on the main body 110 so as to open or close the openings 111*a* and 113.

The washing device 100 may further include a water supply device 222 that supplies washing water to the tub 111. The water supply device 222 may include a water supply pipe 223 connected to an external water supply source such as a tap, and a water supply valve 224 positioned in the water supply pipe 223 so as to control the supply of the washing water through the water supply pipe 223. A detergent input device 225 through which various detergents, such as a fabric softener, a bleaching agent, and the like, can be input, may be connected to the water supply pipe 223.

The washing device 100 may further include a draining device 227 that drains the washing water stored in the tub 111 toward the outside of the main body 110 after the washing cycle is terminated. The draining device 227 may include a draining pipe 228 that guides the washing water of the tub 111 to the outside of the main body 110, and a draining pump 229 that pumps the washing water of the tub 111.

The clothes treating apparatus 1*b* may further include a drying device 30.

The drying device 30 may be positioned at an upper portion of the washing device 100.

An inlet 110*e* through which external air is introduced, and an outlet 110*f* through which the external air is discharged, may be formed in the upper main body 110*a*. The inlet 110*e* and the outlet 110*f* may be formed in different surfaces or in the same surface of the upper main body 110*a*, FIG. 3 illustrates the case where the inlet 110*e* is formed in a rear surface of the upper main body 110*a* and the outlet 110*f* is formed in a front surface of the upper main body 110*a*. Positions of the inlet 110*e* and the outlet 110*f* may be changed.

The drying device 30 may include a drying chamber 31 positioned inside the upper main body 110*a* so as to accommodate the object to be dried. The drying chamber 31 may have a box shape with one opened surface. A plurality of blowing ports 31*c* may be formed in the bottom plate 31*b* of the drying chamber 31. At least one air inlet 31*e* may be formed in the rear surface 31*d* of the drying chamber 31. An air outlet 31*f* may be formed in a front surface of the drying chamber 31.

The drying device 30 may further include a door 92 rotatably installed on the upper main body 110*a* so as to open or close the drying chamber 31. The door 92 may be rotatably installed at an upper side of the upper main body 110*a* so as to put the object to be dried into the drying chamber 31 in an up loading manner.

The drying device 30 may further include a drying duct 180 formed between the upper main body 110*a* and the drying chamber 31. External air may be introduced into the drying duct 180, and the air introduced into the drying duct 180 may be heated by the heater 160 and then may be introduced into the drying chamber 31 via the plurality of blowing ports 31*c* and at least one air inlet 31*e*.

The drying device 30 may further include the heater 160 configured to heat the external air introduced via the inlet 110*e*. The heater 160 may be positioned inside the drying duct 180. In detail, the heater 160 may be positioned inside the drying duct 180 to be positioned between the inlet 110*e* and the drying chamber 31.

The drying device 30 may further include a blower fan 150 configured to blow the air heated by the heater 160 into the drying chamber 31. The blower fan 150 may be positioned inside the drying duct 180 to be adjacent to the heater 160.

In this way, the clothes treating apparatus 1*b* including both the washing device 100 and the drying device 30 may increase usage convenience for a user. The user may complete washing of the laundry using the washing device 100 and then may easily perform drying of the laundry using the drying device 30 positioned at the upper portion of the washing device 100.

In FIGS. 2 and 3, the clothes treating apparatus 1*a* including a plurality of drying devices and the clothes treating apparatus 1*b* including a washing device and a drying device have been described. A clothes treating apparatus may include only a drying device, unlike in the embodiments of FIGS. 2 and 3. In this way, when the clothes treating apparatus includes only a drying device, the clothes treating apparatus may also be referred to as the drying device.

Hereinafter, a drying device having various shapes will now be described.

Figure 4A:
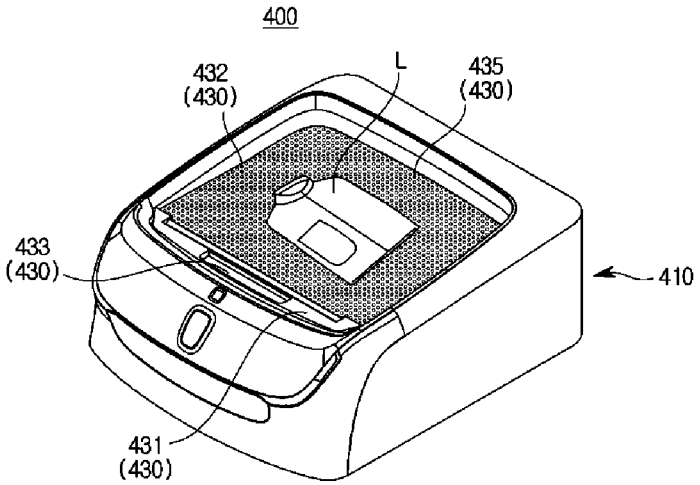
FIGS. 4A and 4B are perspective views of an operation of putting/taking a second drying rack into/out of a drying device according to a first embodiment.
Figure 4B:
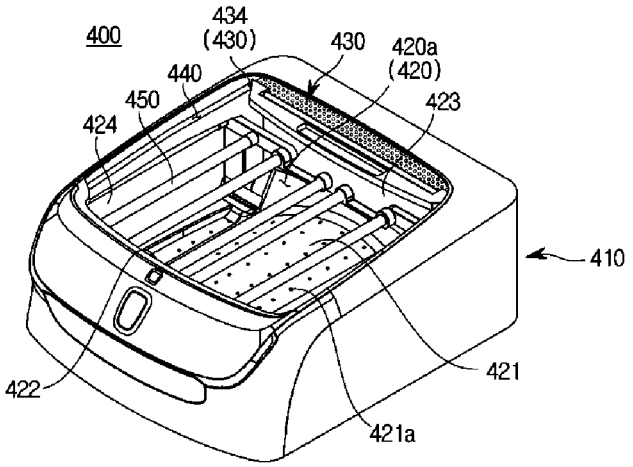
Figure 5:
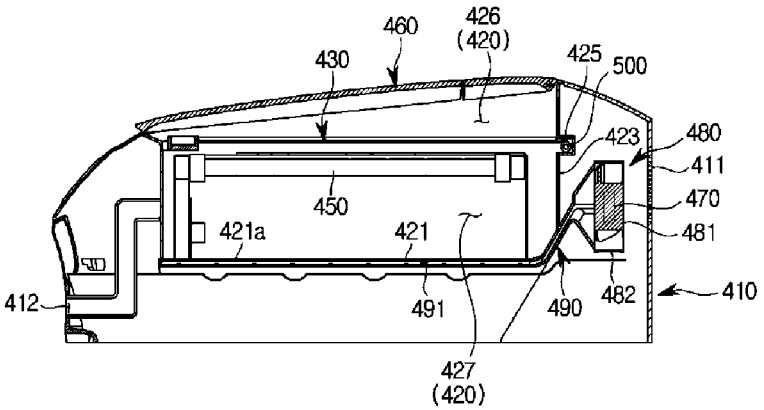
FIG. 5 is a cross-sectional view of the drying device of FIG. 4A.
Figure 6:
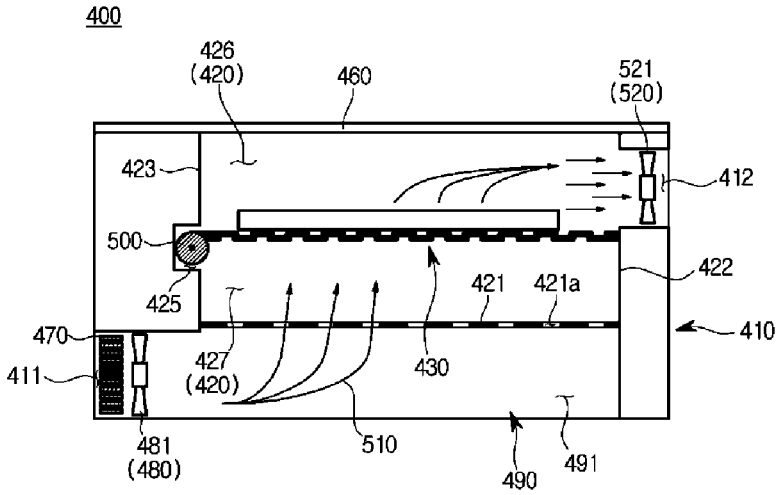
FIG. 6 is a schematic view of the air flow in the drying device according to the first embodiment.

FIGS. 4A and 4B are perspective views of an operation of putting/taking a second drying rack into/out of a drying device according to a first embodiment, and FIG. 5 is a cross-sectional view of the drying device of FIG. 4A. FIG. 6 is a schematic view of the air flow in the drying device according to the first embodiment. FIG. 4A illustrates the state in which a second drying rack 430 has been taken out of the drying device, and FIG. 4B illustrates the state in which the second drying rack 430 has been put into the drying device. FIGS. 4A to 5 illustrate the case where a discharge unit 520 is omitted, and FIG. 6 illustrates the case where the discharge unit 520 is installed.

As illustrated in FIGS. 4A through 6, the drying device 400 may include a casing 410. The casing 410 may constitute an exterior of the drying device 400. An inlet 411 into which air is introduced, and an outlet 412 from which air is discharged, may be formed in the casing 410.

The drying device 400 may further include a drying chamber 420 positioned inside the casing 410. The drying chamber 420 may have one opened surface. The one opened surface of the drying chamber 420 may be defined as an input port 420*a*. The drying chamber 420 may include a bottom plate 421. The bottom plate 421 may correspond to the input port 420*a*. A plurality of blowing ports 421*a* may be formed in the bottom plate 421. The drying chamber 420 may further include a front plate 422 that faces the front of the drying device 400, a rear plate 423 that faces the rear of the drying device 400, and side plates 424 that face sides of the drying device 400.

The drying chamber 420 may be divided into a plurality of spaces using the second drying rack 430. In detail, an internal space of the drying chamber 420 may be divided into a plurality of spaces using the second drying rack 430. In more detail, the internal space of the drying chamber 420 may be divided into a plurality of spaces in a state in which the second drying rack 430 is interposed between the plurality of spaces when the second drying rack 430 is parallel to the bottom plate 421 of the drying chamber 420. The plurality of spaces may include a first space 426 formed at an upper portion of the second drying rack 430 so as to be adjacent to the door 460, and a second space 427 formed at a lower portion of the second drying rack 430 so as to communicate with the first space 426. A first drying rack 450 may be installed so as to be positioned in the second space 427.

The drying device 400 may further include the second drying rack 430 installed inside the drying chamber 420. The second drying rack 430 may be installed inside the drying chamber 420 so as to be put into or taken out of the drying device 400. The second drying rack 430 may divide the drying chamber 420 into a plurality of chambers. The second drying rack 430 may include a frame 431. A handle 433 may be positioned in the frame 431. The user may easily put/take the second drying rack 430 into/out of the drying device 400 using the handle 433. The handle 433 may have a shape recessed to a predetermined depth, and the shape of the handle 433 may be modified in various ways. The second drying rack 430 may further include a protrusion 434 that protrudes from the frame 431. The protrusion 434 may be movably coupled to a guide rail 440 that will be described below and by which movement of the second drying rack 430 is guided. A roller (not shown) may be coupled to the protrusion 434 so as to implement smooth movement of the second drying rack 430. The second drying rack 430 may further include a mesh body 432. The mesh body 432 may be coupled to the frame 431. Also, the mesh body 432 may be made of a flexible material so as to be wound on a winder 500. The mesh body 432 may have a mesh structure. In another aspect, the mesh body 432 may have a plurality of communication holes 435. Through the mesh structure of the mesh body 432, ventilation of the object to be dried put on the mesh body 432 can be smoothly performed so that drying efficiency can be improved.

The drying device 400 may further include the guide rail 440. The guide rail 440 may support the second drying rack 430. The guide rail 440 may be formed at an inner wall of the drying chamber 420 so as to guide putting and taking the second drying rack 430 into and out the drying device 400. In an example, the guide rail 440 may be formed at both sidewalk 424 of the drying chamber 420. However, the position of the guide rail 440 is not limited to the above example and may be changed in various ways according to a direction in which the second drying rack 430 is put into or taken out of the drying device 400. The guide rail 440 may be formed parallel to the first drying rack 450 that will be described below.

The drying device 400 may further include the first drying rack 450 installed inside the drying chamber 420. The object to be dried may be dried while being hung on or fitted into the first drying rack 450. In an example, the object to be dried, such as shoes, underwear, and the like, may be dried while being hung on or fitted into the first drying rack 450. The first drying rack 450 may be positioned at a lower portion of the second drying rack 430.

The drying device 400 may further include the winder 500 on which the second drying rack 430 is wound. In detail, the winder 500 may be rotatably installed so that the mesh body 432 of the second drying rack 430 can be wound. The winder 500 may be rotatably mounted on a winder mounting part 425 recessed in the rear surface 423 of the drying chamber 420.

The drying device 400 may further include a drying duct 490 positioned inside the casing 410 so as to form the bottom plate 421 of the drying chamber 420. In detail, an upper plate of the drying duct 490 may form the bottom plate 421 of the drying chamber 420. A flow path 491 may be formed inside the drying duct 490 so that air may move through the flow path 491. The drying chamber 420 may communicate with the drying duct 490 via the plurality of blowing ports 421*a* formed in the bottom plate 421 of the drying chamber 420. That is, the air that moves along the flow path 491 inside the drying duct 490 may pass through the plurality of blowing ports 421*a* and may be introduced into the drying chamber 420.

The drying device 400 may further include a heater 470. The heater 470 may be positioned inside the casing 410 so as to heat the air introduced into the drying chamber 420.

The drying device 400 may include an intake unit 480 and a discharge unit 520 (see FIG. 6). The intake unit 480 may include an intake fan 481 through which external air is introduced into the casing 410, an intake fan housing (not shown) in which the intake fan 481 is accommodated, and an intake fan driving motor (not shown) configured to drive the intake fan 481. The intake unit 480 may be positioned adjacent to the heater 470 so as to blow the air heated by the heater 470 into the drying chamber 420. Also, the intake unit 480 may be coupled to the drying duct 490 so that the intake fan 481 may communicate with the flow path 491 inside the drying duct 490. The discharge unit 520 may include a discharge fan 521 through which humid air generated in a drying operation is discharged to the outside of the casing 410, a discharge fan housing (not shown) in which the discharge fan 521 is accommodated, and a discharge fan driving motor (not shown) configured to drive the discharge fan 521.

The drying device 400 may further include the door 460 installed on the casing 410 so as to open or close the drying chamber 420. The door 460 may be installed on the casing 410 so as to be rotatable.

The drying device 400 may further include a drying flow path 510. The drying flow path 510 may connect the drying duct 490 to the drying chamber 420 so that the air passing through the drying duct 490 can be introduced into the drying chamber 420. The heater 470, the intake fan 481, and the discharge fan 521 may be positioned in the drying flow path 510.

The object to be dried may be positioned on the second drying rack 430 or on the bottom plate 421 of the drying chamber 420, or may be dried while being hung on the first drying rack 450. In this way, when the second drying rack 430 and the first drying rack 450 are installed inside the drying chamber 420, space utilization of the drying chamber 420 can be improved. Also, when the second drying rack 430 and the first drying rack 450 are installed inside the drying chamber 420, a considerable amount of the object to be dried can be prevented from being dried in a folded state so that the effect of improving drying efficiency is expectable.

External air may be introduced into the casing 410 via the inlet 411 due to an operation of the intake fan 481. The air introduced into the casing 410 is heated by the heater 470 and then is introduced into the flow path 491 of the drying duct 490. The air introduced into the flow path 491 of the drying duct 490 is introduced into the drying chamber 420 via the plurality of blowing ports 421*a*. The air introduced into the drying chamber 420 is changed into humid air due to an interaction with the object to be dried. The humid air is discharged to the outside of the casing 410 due to an operation of the discharge fan 521.

Figure 7:
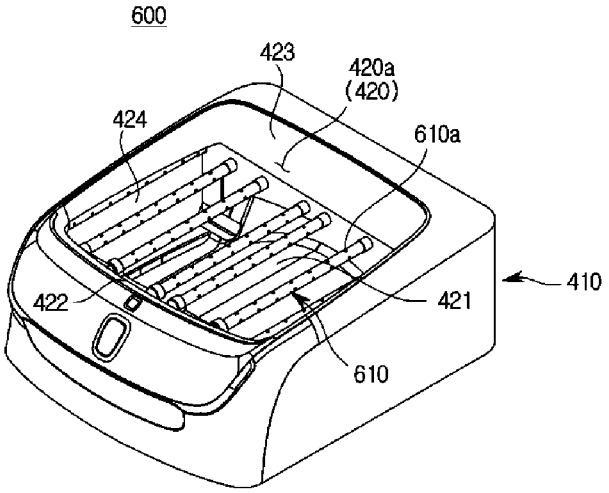
FIG. 7 is a perspective view of a drying device according to a second embodiment.
Figure 8:
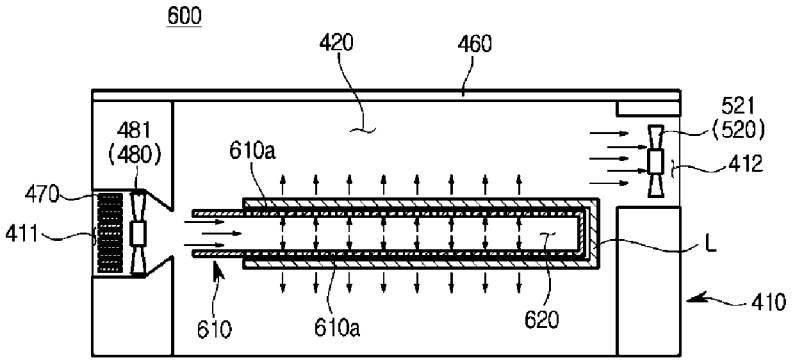
FIG. 8 is a schematic view of the air flow in the drying device according to the second embodiment.

FIG. 7 is a perspective view of a drying device according to a second embodiment, and FIG. 8 is a schematic view of the air flow in the drying device according to the second embodiment. FIG. 8 illustrates the case where the object to be dried is dried while being fitted into a drying rack 610. Hereinafter, a redundant description of a drying device 400 according to the first embodiment will be omitted. Hereinafter, for the description of unexplained reference numerals, FIGS. 4 through 6 will be referred to.

As illustrated in FIGS. 7 and 8, a drying device 600 may include a casing 410. An inlet 411 into which air is introduced, and an outlet 412 from which air is discharged, may be formed in the casing 410.

The drying device 600 may further include a drying chamber 420 positioned inside the casing 410. The drying chamber 420 may have one opened surface. The one opened surface of the drying chamber 420 may be defined as an input port 420*a*. The drying chamber 420 may include a bottom plate 421. The bottom plate 421 may correspond to the input port 420*a*. The drying chamber 420 may further include a front plate 422 that faces the front of the drying device 600, a rear plate 423 that faces the rear of the drying device 600, and side plates 424 that face sides of the drying device 600. In this case, no additional element for air movement may be formed in the bottom plate 421 of the drying chamber 420.

The drying device 600 may further include a drying rack 610 installed inside the drying chamber 420. One end of the drying rack 610 may be fixed to an inner wall of the drying chamber 420, and the other end of the drying rack 610 may be spaced apart from the inner wall of the drying chamber 420. However, the structure of the drying rack 610 is not limited to the above example. In an example, all of both ends of the drying rack 610 may also be fixed to the inner wall of the drying chamber 420. The object to be dried may be dried while being hung on or fitted into the drying rack 610. In an example, the object to be dried, such as shoes, underwear, and the like, may be dried while being hung on or fitted into the drying rack 610. The drying device 600 may include at least one drying rack 610.

The drying rack 610 may include a plurality of air flow holes 610*a*. The plurality of air flow holes 610*a* may be formed in a surface of the drying rack 610 so that a drying flow path 620 communicates with the drying chamber 420. In an example, the plurality of air flow holes 610*a* may be formed in a top surface and a bottom surface of the drying rack 610. The plurality of air flow holes 610*a* may be regularly formed in the surface of the drying rack 610. The plurality of air flow holes 610*a* may also be irregularly formed in the surface of the drying rack 610. However, a plurality of air nozzles having a nozzle shape, instead of the plurality of air flow holes 610*a*, may be formed in the drying rack 610.

The drying device 600 may further include a heater 470. The heater 470 may be positioned inside the casing 410 so as to heat the air introduced into the drying chamber 420.

The drying device 600 may include an intake unit 480 and a discharge unit 520 (see FIG. 8). The intake unit 480 may be positioned adjacent to the heater 470 so as to blow the air heated by the heater 470 into the drying chamber 420. Also, the intake unit 480 may be coupled to the drying chamber 420 so that the intake fan 481 may communicate with the drying chamber 420.

The drying device 600 may further include a door 460 installed on the casing 410 so as to open or close the drying chamber 420.

The drying device 600 may include the drying flow path 620. The drying flow path 620 may be formed inside the drying rack 610 so that the air passing through the drying rack 610 may be introduced into the drying chamber 420. The air that moves along the drying flow path 620 may be dispersed into the drying chamber 420 via the plurality of air flow holes 610*a*. In this case, the air that moves along the drying flow path 620 may be dispersed into the drying chamber 420 so as to be directed in a plurality of directions via the plurality of air flow holes 610*a*. In an example, the air that moves along the drying flow path 620 may be dispersed into the drying chamber 420 so as to be directed in an upward direction and a downward direction via the plurality of air flow holes 610*a*.

External air may be introduced into the casing 410 via the inlet 411 due to an operation of the intake fan 481. The air introduced into the casing 410 is heated by the heater 470 and then is introduced into the drying flow path 620 formed inside the drying rack 610. The air introduced into the drying flow path 620 is dispersed into the drying chamber 420 via the plurality of air flow holes 610*a*. The air dispersed into the drying chamber 420 is changed into humid air due to an interaction with the object to be dried. The humid air is discharged to the outside of the casing 410 via the outlet 412 due to an operation of the discharge fan 521.

Figure 9:
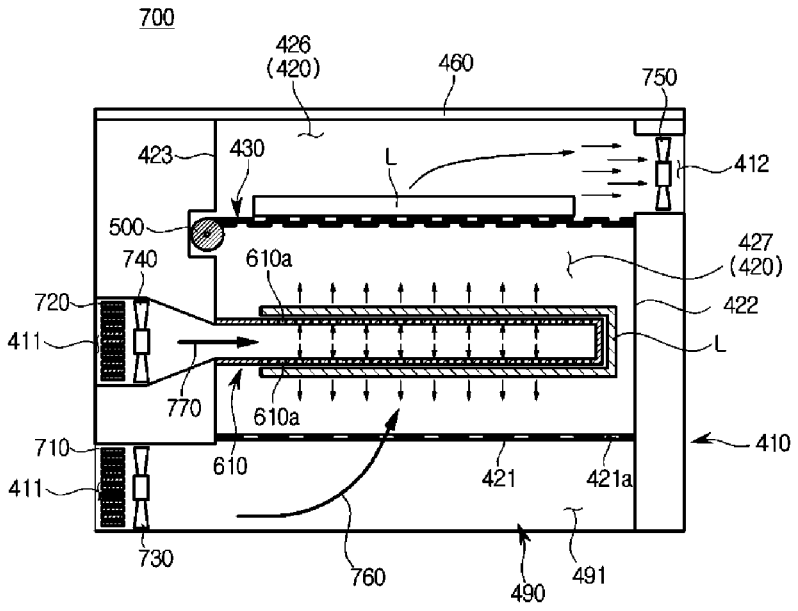
FIG. 9 is a schematic view of the air flow in a drying device according to a third embodiment.

FIG. 9 is a schematic view of the air flow in a drying device according to a third embodiment. Hereinafter, a redundant description of the drying device 400 according to the first embodiment and the drying device 600 according to the second embodiment will be omitted. Hereinafter, for unexplained reference numerals, the drying device 400 according to the first embodiment and the drying device 600 according to the second embodiment will be referred to.

As illustrated in FIG. 9, a drying device 700 may have a combined structure of the drying device 400 according to the first embodiment and the drying device 600 according to the second embodiment.

The drying device 700 includes all of elements of the drying device 400 according to the first embodiment. Thus, hereinafter, elements of the drying device 700 different from that of the drying device 400 according to the first embodiment will be described.

The drying rack 610 may include a plurality of air flow holes 610*a*. The plurality of air flow holes 610*a* may be formed in a surface of the drying rack 610. A description of the plurality of air flow holes 610*a* is the same as those of the drying device 600 according to the second embodiment and thus will be omitted.

The drying device 700 may include a plurality of heaters. The plurality of heaters may be positioned inside the casing 410 so as to heat the air introduced into the drying chamber 420. The plurality of heaters may include a first heater 710 configured to heat the air that moves along a first drying flow path 760. The plurality of heaters may further include a second heater 720 configured to heat the air that moves along a second drying flow path 770. The first heater 710 may be positioned below the second heater 720. However, positions of the first heater 710 and the second heater 720 are not limited to the above example and may be modified in various ways.

The drying device 700 may include a plurality of intake units. The plurality of intake units may be positioned adjacent to the plurality of heaters so as to blow the air heated by the plurality of heaters into the drying chamber 420. The plurality of intake units may include a first intake unit 730. The first intake unit 730 may be positioned adjacent to the first heater 710 so as to blow the air heated by the first heater 710 into the drying chamber 420. The first intake unit 730 may be coupled to the drying duct 490 so that the intake fan 481 may communicate with the drying duct 490. The plurality of intake units may further include a second intake unit 740. The second intake unit 740 may be positioned adjacent to the second heater 720 so as to blow the air heated by the second heater 720 into the drying chamber 420. The second intake unit 740 may be coupled to the drying chamber 420 so that the intake fan 481 may communicate with the drying chamber 420.

The drying device 700 may include a discharge unit 750. The external air introduced into the casing 410 via the plurality of intake units may be discharged to the outside of the casing 410 via one discharge unit 750. However, the number of discharge units 750 is not limited to one, and a plurality of discharge units 750 may also be implemented.

The drying device 700 may include a plurality of drying flow paths. The plurality of drying flow paths may include the first drying flow path 760. The first drying flow path 760 may connect the drying duct 490 to the drying chamber 420 so that the air passing through the drying duct 490 may be introduced into the drying chamber 420. The plurality of drying flow paths may further include the second drying flow path 770. The second drying flow path 770 may be formed inside the drying rack 610 so that the air passing through the drying rack 610 may be introduced into the drying chamber 420. The air that moves along the second drying flow path 770 is dispersed into the drying chamber 420 via the plurality of air flow holes 610*a*.

External air may be introduced into the casing 410 via the inlet 411 due to an operation of the intake fan 481. A portion of the air introduced into the casing 410 is heated by the first heater 710 and then is introduced into the flow path 491 of the drying duct 490. The air introduced into the flow path 491 of the drying duct 490 is introduced into the drying chamber 420 via the plurality of blowing ports 421*a*. The other portion of the air introduced into the casing 410 is heated by the second heater 720 and then is introduced into the drying rack 610. The air introduced into the drying rack 610 is dispersed into the drying chamber 420 via the plurality of air flow holes 610*a*. The air introduced into the drying chamber 420 is changed into humid air due to an interaction with the object to be dried. The humid air is discharged to the outside of the casing 410 via the outlet 412 due to an operation of the discharge fan 521.

Figure 10A:
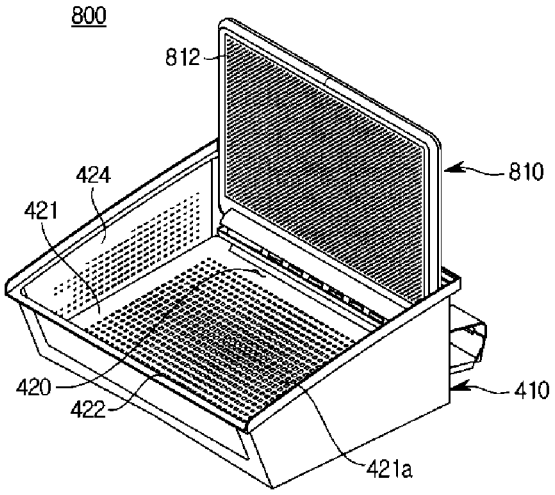
FIGS. 10A and 10B are perspective views of a rotating operation of the second drying rack of a drying device according to a fourth embodiment.
Figure 10B:
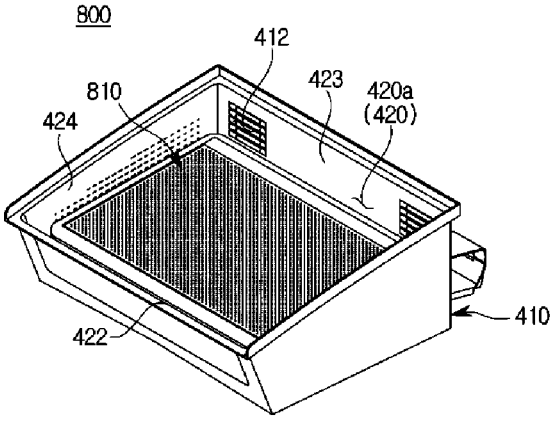
Figure 11:
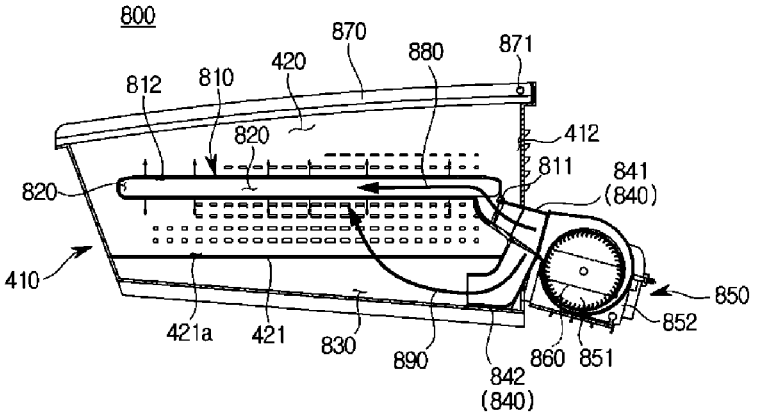
FIG. 11 is a schematic view of the air flow in the drying device according to the fourth embodiment.

FIGS. 10A and 10B are perspective views of a rotating operation of the second drying rack of a drying device according to a fourth embodiment, and FIG. 11 is a schematic view of the air flow in the drying device according to the fourth embodiment.

As illustrated in FIGS. 10A through 11, a drying device 800 may include a casing 410. The casing 410 may constitute an exterior of the drying device 800. An outlet 412 from which air is discharged, may be formed in the casing 410. The outlet 412 may be formed in a rear surface of the casing 410 so as to communicate with a rear surface 423 of the drying chamber 420. However, the position of the outlet 412 is not limited to the rear surface of the casing 410. Air may be introduced into the casing 410 via an intake unit 850 that will be described below.

The drying device 800 may further include the drying chamber 420 positioned inside the casing 410. The drying chamber 420 may have one opened surface. The one opened surface of the drying chamber 420 may be defined as an input port 420*a*. The drying chamber 420 may include a bottom plate 421. The bottom plate 421 may correspond to the input port 420*a*. A plurality of blowing ports 421*a* may be formed in the bottom plate 421. In detail, the plurality of blowing ports 421*a* may be formed in the bottom plate 421 of the drying chamber 420 so that the drying chamber 420 may communicate with an air movement space 830. The drying chamber 420 may further include a front plate 422 that faces the front of the drying device 800, a rear plate 423 that faces the rear of the drying device 800, and side plates 424 that face sides of the drying device 800.

The drying device 800 may further include a second drying rack 810 installed inside the drying chamber 420. The second drying rack 810 may be installed inside the drying chamber 420 so as to be rotatable. The second drying rack 810 may be installed to be rotatable around a second drying rack rotating shaft 811. The second drying rack 810 may divide the drying chamber 420 into a plurality of spaces. A plurality of air communication holes 812 may be formed in the surface of the second drying rack 810. The plurality of air communication holes 812 may be formed in a plurality of surfaces of the second drying rack 810. Preferably, the plurality of air communication holes 812 may be formed in a top surface and a bottom surface of the second drying rack 810. The second drying rack 810 may include an air inlet into which air is introduced. The air inlet may be formed at a connection part of the second drying rack 810 and a first duct 841.

The drying device 800 may further include a drying rack flow path 820. The drying rack flow path 820 may be formed in the second drying rack 810 so that air moves in the drying rack flow path 820.

The drying device 800 may further include the air movement space 830 formed between the drying chamber 420 and the casing 410. The air movement space 830 may be formed in the casing 410 so as to be positioned below the drying chamber 420.

The drying device 800 may further include a drying duct 840 configured to supply air into the casing 410. The drying duct 840 may include the first duct 841 configured to supply air to the drying rack flow path 820. The drying duct 840 may further include a second duct 842 configured to supply air into the air movement space 830. The first duct 841 and the second duct 842 may be integrally formed. In another aspect, the drying duct 840 may include the first duct 841 that connects the second drying rack 810 to the intake unit 850. The drying duct 840 may further include the second duct 842 that connects the air movement space 830 to the intake unit 850.

The second drying rack 810 may be rotatably coupled to the drying duct 840. In detail, the second drying rack 810 may be rotatably coupled to the first duct 841. In more detail, the second drying rack 810 may be rotatably coupled to the first duct 841 due to a second drying rack rotating shaft 811. An air inlet of the second drying rack 810 may be positioned close to the second drying rack rotating shaft 811.

The drying device 800 may further include a heater 860. The heater 860 may be configured to heat the air introduced into the casing 410. In detail, the heater 860 may be positioned outside the casing 410 so as to heat the air introduced into the drying duct 840. However, it is sufficient that the heater 860 may heat the air introduced into the drying duct 840, and the position of the heater 860 is not limited to the outside of the casing 410.

The drying device 800 may further include the intake unit 850. The intake unit 850 may include an intake fan 851 for intaking external air into the casing 410, an intake fan housing 852 in which the intake fan 851 is accommodated, and an intake fan driving motor (not shown) configured to drive the intake fan 851. The intake unit 850 may be positioned adjacent to the heater 860 so as to blow the air heated by the heater 860 into the drying duct 840. Also, the intake unit 850 may be coupled to the drying duct 840 so that the intake fan 851 may communicate with the drying duct 840.

The drying device 800 may further include a discharge unit (not shown).

The discharge unit may include a discharge fan for discharging humid air generated in a drying operation to the outside of the casing 410, a discharge fan housing in which the discharge fan is accommodated, and a discharge fan driving motor configured to drive the discharge fan.

The drying device 800 may further include a door 870 installed on the casing 410 so as to open or close the drying chamber 420. The door 870 may be installed on the casing 410 to be rotatable around a door rotating shaft 871. The door rotating shaft 871 and a second drying rack rotating shaft 811 may be parallel to each other.

The drying device 800 may further include a plurality of drying flow paths. The plurality of drying flow paths may include a first drying flow path 880. The first drying flow path 880 may be formed in such a way that external air may be introduced into the drying chamber 420 via the drying rack flow path 820. The first drying flow path 880 may include the intake unit 850, the first duct 841, the drying rack flow path 820, and the drying chamber 420. The plurality of drying flow paths may further include a second drying flow path 890. The second drying flow path 890 may be formed in such a way that external air may be introduced into the drying chamber 420 through the air movement space 830. The second drying flow path 890 may include the intake unit 850, the second duct 842, the air movement space 830, and the drying chamber 420. The air that moves along the first drying flow path 880 may be dispersed into the drying chamber 420 via the plurality of air communication holes 812 formed in the second drying rack 810. The air that moves along the second drying flow path 890 may be introduced into the drying chamber 420 via the plurality of blowing ports 421*a* formed in the bottom plate 421 of the drying chamber 420.

External air heated by the heater 860 is introduced into the intake fan housing 852 due to an operation of the intake fan 851. A portion of the air introduced into the intake fan housing 852 is introduced into the drying rack flow path 820 of the second drying rack 810 via the first duct 841. The air introduced into the drying rack flow path 820 is introduced into the drying chamber 420 via the plurality of air communication holes 812. The other portion of the air introduced into the intake fan housing 852 is introduced into the air movement space 830 via the second duct 842. The air introduced into the air movement space 830 is introduced into the drying chamber 420 via the plurality of blowing ports 421*a*. The air introduced into the drying chamber 420 is changed into humid air due to an interaction with the object to be dried. The humid air is discharged to the outside of the casing 410 via the outlet 412 due to an operation of the discharge fan.

Figure 12A:
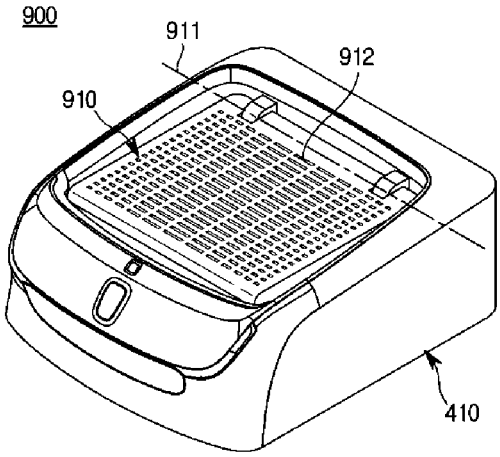
FIGS. 12A and 12B are perspective views of a rotating operation of a second drying rack of the drying device according to a fifth embodiment.
Figure 12B:
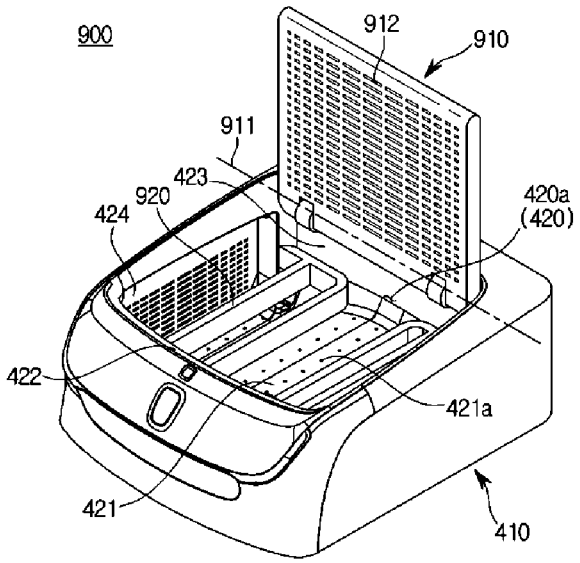

FIGS. 12A and 12B are perspective views of a rotating operation of a second drying rack of the drying device according to a fifth embodiment. In FIGS. 12A and 12B, a door of the drying device is omitted.

As illustrated in FIGS. 12A and 12B, a drying device 900 may include a casing 410. The casing 410 may constitute the exterior of the drying device 900. An inlet (not shown) into which air is introduced, and an outlet (not shown) may be formed in the casing 410.

The drying device 900 may further include a drying chamber 420 positioned in the casing 410. The drying chamber 420 may have one opened surface. The one opened surface of the drying chamber 420 may be defined as an input port 420*a*. The drying chamber 420 may include a bottom plate 421. The bottom plate 421 may correspond to an input port 420*a*. A plurality of blowing ports 421*a* may be formed in the bottom plate 421. The drying chamber 420 may further include a front plate 422 that faces the front of the drying device 900, a rear plate 423 that faces the rear of the drying device 900, and side plates 424 that face sides of the drying device 900.

The drying device 900 may further include a second drying rack 910 installed inside the drying chamber 420. The second drying rack 910 may be installed inside the drying chamber 420 so as to be rotatable. The second drying rack 910 may be installed to be rotatable around a second drying rack rotating shaft 911. The second drying rack 910 may divide the drying chamber 420 into a plurality of spaces. A plurality of air communication holes 912 may be formed in the second drying rack 910.

The drying device 900 may further include a first drying rack 920 installed inside the drying chamber 420. The object to be dried may be dried while being hung on or fitted into the first drying rack 920. In an example, the object to be dried, such as shoes, underwear, and the like, may be dried while being hung on or fitted into the first drying rack 920.

The drying device 900 may further include a drying duct (not shown) positioned inside the casing 410 so as to form the bottom plate 421 of the drying chamber 420. A description of the drying duct is the same as that of the drying device 400 according to the first embodiment and thus will be omitted.

The drying device 900 may further include a heater (not shown). A description of the heater is the same as that of the drying device 400 according to the first embodiment and thus will be omitted.

The drying device 900 may further include an intake unit. A description of the intake unit is the same as that of the drying device 400 according to the first embodiment and thus will be omitted.

The drying device 900 may further include a door (not shown) installed on the casing 410 so as to open or close the drying chamber 420. The door may be installed on the casing 410 so as to be rotatable. The door may be installed on the casing 410 to be rotatable around a door rotating shaft. The door rotating shaft and the second drying rack rotating shaft 911 may be parallel to each other.

The drying device 900 may further include a drying flow path (not shown).

A description of the drying flow path is the same as that of the drying device 400 according to the first embodiment and thus will be omitted.

A description of the air flow is also the same as that of the drying device 400 according to the first embodiment and thus will be omitted.

Figure 13A:
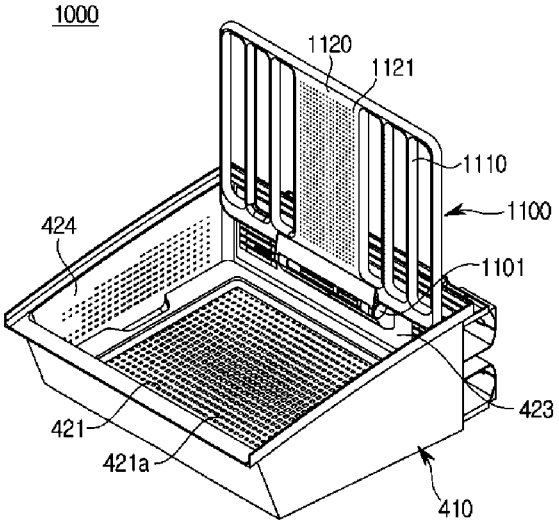
FIGS. 13A and 13B are perspective views of a rotating operation of a second drying rack of the drying device according to a sixth embodiment.
Figure 13B:
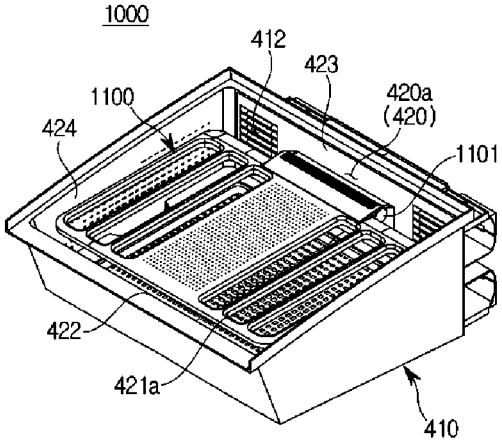
Figure 14:
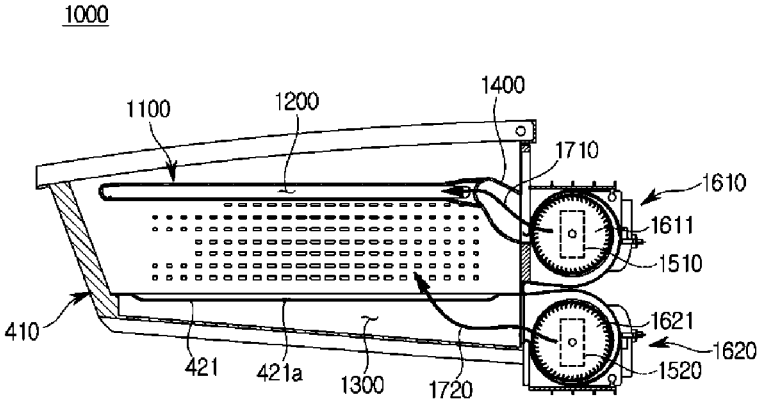
FIG. 14 is a cross-sectional view of the drying device of FIG. 13A.

FIGS. 13A and 13B are perspective views of a rotating operation of a second drying rack of the drying device according to a sixth embodiment, and FIG. 14 is a cross-sectional view of the drying device of FIG. 13A.

As illustrated in FIGS. 13A through 14, a drying device 1000 may include a casing 410. The casing 410 may constitute an exterior of the drying device 1000. An outlet 412 from which air is discharged, may be formed in the casing 410. The outlet 412 may be formed in a rear surface of the casing 410 so as to communicate with a rear surface 423 of the drying chamber 420. However, the position of the outlet 412 is not limited to the rear surface of the casing 410. Air may be introduced into the casing 410 via intake units 1610 and 1620 that will be described below.

The drying device 1000 may further include a drying chamber 420 positioned inside the casing 410. The drying chamber 420 may have one opened surface. The one opened surface of the drying chamber 420 may be defined as an input port 420*a*. The drying chamber 420 include a bottom plate 421. The bottom plate 421 may correspond to the input port 420*a*. A plurality of blowing ports 421*a* may be formed in the bottom plate 421. In detail, the plurality of blowing ports 421*a* may be formed in the bottom plate 421 of the drying chamber 420 so that the drying chamber 420 may communicate with an air movement space 1300. The drying chamber 420 may further include a front plate 422 that faces the front of the drying device 1000, a rear plate 423 that faces the rear of the drying device 1000, and side plates 424 that face sides of the drying device 1000.

The drying device 1000 may further include a second drying rack 1100 installed inside the drying chamber 420. The second drying rack 1100 may be installed inside the drying chamber 420 so as to be rotatable. The second drying rack 1100 may be installed to be rotatable around a second drying rack rotating shaft 1101. The second drying rack 1100 may divide the drying chamber 420 into a plurality of spaces. The second drying rack 1100 may include a plurality of drying racks 1110, and a drying rack connection part 1120 positioned between the plurality of drying racks 1110 so as to connect the plurality of drying racks 1110 to one another. The plurality of drying racks 1110 and the drying rack connection part 1120 may be integrally formed. The object to be dried may be dried while being hung on the drying rack 1110. Also, the object to be dried may be dried while being positioned on the drying rack connection part 1120. A plurality of air communication holes 1121 may be formed in the surface of the drying rack connection part 1120. The plurality of air communication holes 1121 may be formed in a plurality of surfaces of the drying rack connection part 1120. Preferably, the plurality of air communication holes 1121 may be formed in a top surface and a bottom surface of the drying rack connection part 1120.

The drying device 1000 may further include a drying rack flow path 1200.

The drying rack flow path 1200 may be formed in the second drying rack 1100 so that air may move in the drying rack flow path 1200.

The drying device 1000 may further include the air movement space 1300 formed between the drying chamber 420 and the casing 410. The air movement space 1300 may be formed within the casing 410 so as to be positioned below the drying chamber 420.

The drying device 1000 may further include a drying duct 1400 configured to supply air into the casing 410. In detail, the drying duct 1400 may be configured to supply air to the drying rack flow path 1200. In another aspect, the drying duct 1400 may be configured to connect the second drying rack 1100 to a first intake unit 1610.

The second drying rack 1100 may be rotatably coupled to the drying duct 1400.

The drying device 1000 may further include a plurality of heaters. The plurality of heaters may be positioned outside the casing 410 so as to heat the air introduced into the drying chamber 420. The plurality of heaters may include a first heater 1510 configured to heat the air introduced into the drying rack flow path 1200. The plurality of heaters may further include a second heater 1520 configured to heat the air introduced into the air movement space 1300. The first heater 1510 may be positioned above the second heater 1520. However, the positions of the first heater 1510 and the second heater 1520 are not limited to the above example and may be modified in various ways.

The drying device 1000 may include a plurality of intake units. The plurality of intake units may be positioned adjacent to the plurality of heaters so as to blow the air heated by the plurality of heaters into the drying chamber 420. The plurality of intake units may include the first intake unit 1610. The first intake unit 1610 may be positioned adjacent to the first heater 1510 so as to blow the air heated by the first heater 1510 into the drying rack flow path 1200. The first intake unit 1610 may be coupled to the casing 410 so that the intake fan 1611 may communicate with the drying duct 1400. The plurality of intake units may further include a second intake unit 1620. The second intake unit 1620 may be positioned adjacent to the second heater 1520 so as to blow the air heated by the second heater 1520 into the air movement space 1300. The second intake unit 1620 may be coupled to the casing 410 so that the intake fan 1621 may communicate with the air movement space 1300.

The drying device 1000 may include a discharge unit (not shown). The external air introduced into the casing 410 via the plurality of intake units may be discharged to the outside of the casing 410 via one discharge unit. However, the number of discharge units is not limited to one, and a plurality of discharge units may be implemented. The discharge unit may include a discharge fan for discharging humid air generated in a drying operation to the outside of the casing 410, a discharge fan housing in which a discharge fan is accommodated, and a discharge fan driving motor configured to drive the discharge fan.

The drying device 1000 may include a plurality of drying flow paths. The plurality of drying flow paths may include a first drying flow path 1710. The first drying flow path 1710 may connect the drying duct 1400 to the drying chamber 420 so that the air passing through the drying duct 1400 may be introduced into the drying chamber 420. The plurality of drying flow paths may further include a second drying flow path 1720. The second drying flow path 1720 may connect the air movement space 1300 to the drying chamber 420 so that the air passing through the air movement space 1300 may be introduced into the drying chamber 420. The air that moves along the first drying flow path 1710 may be introduced into the drying rack flow path 1200 via the drying duct 1400, and the air introduced into the drying rack flow path 1200 may be dispersed into the drying chamber 420 via the plurality of air communication holes 1121. The air that moves along the second drying flow path 1720 is introduced into the air movement space 1300, and the air introduced into the air movement space 1300 is introduced into the drying chamber 420 via the plurality of blowing ports 421*a*.

A portion of the external air is heated by the first heater 1510 and then is introduced into the drying duct 1400 due to an operation of the first intake unit 1610. The air introduced into the drying duct 1400 is introduced into the drying rack flow path 1200 and is dispersed into the drying chamber 420 via the plurality of air communication holes 1121. The other portion of the external air is heated by the second heater 1520 and then is introduced into the air movement space 1300 due to an operation of the second intake unit 1620. The air introduced into the air movement space 1300 is introduced into the drying chamber 420 via the plurality of blowing ports 421*a*. The air introduced into the drying chamber 420 is changed into humid air due to an interaction with the object to be dried. The humid air is discharged to the outside of the casing 410 via the outlet 412 due to an operation of the discharge fan.

While the present invention has been shown and described with reference to certain exemplary embodiments thereof, it will be understood by those skilled in the art that various changes in form and details may be made therein without departing from the spirit and scope of the present invention as defined by the appended claims.

The invention claimed is:

1. A drying device comprising:
- a casing;
- a drum rotatably installed inside the casing;
- a drying chamber integrally formed within the casing and positioned above the drum;
- a hinged door installed on a top surface of the casing to open or close the drying chamber
- a first drying rack positioned inside the drying chamber;
- a second drying rack positioned above the first drying rack; and
- a pair of guide rails configured to support the second drying rack, each of the pair of guide rails being positioned along an inner wall of the drying chamber, wherein the first drying rack comprises:
- a plurality of hollow members through which air flows to form a drying flow path inside the first drying rack, and
- a plurality of air flow holes provided in the hollow members such that the drying flow path inside the first drying rack communicates with the drying chamber through the plurality of air flow holes, and wherein the second drying rack comprises:
- a frame having a handle therein; and
- a mesh body coupled to the frame.

2. The drying device of claim 1, further comprising a winder rotatably installed such that the mesh body is wound on the winder.

3. The drying device of claim 1, further comprising a drying duct configured such that air supplied into the drying chamber flows, and an upper plate of the drying duct forms a bottom plate of the drying chamber.

4. The drying device of claim 3, wherein a plurality of blowing ports are provided in the bottom plate of the drying chamber.

5. The drying device of claim 3, further comprising a heater configured to heat air supplied into the drying chamber.

6. The drying device of claim 5, further comprising an intake unit positioned adjacent to the heater so that air heated by the heater is blown into the drying chamber.

7. The drying device of claim 6, wherein the intake unit is coupled to the drying duct.

8. The drying device of claim 1, wherein the plurality of air flow holes are formed in a top surface and a bottom surface of the first drying rack.

* * * * *